US005927239A

United States Patent [19]

Kohrs et al.

[11] Patent Number: 5,927,239

[45] Date of Patent: Jul. 27, 1999

[54] APPARATUS FOR ADJUSTING VALVE TIMING OF GAS EXCHANGE VALVES IN AN INTERNAL COMBUSTION ENGINE

[75] Inventors: Mike Kohrs, Wilthen; Andreas Strauss, Herzogenaurach; Jochen Auchter, Aurachtal, all of Germany

[73] Assignee: Ina Wälzlager Schaeffler Ohg, Herzogenaurach, Germany

[21] Appl. No.: 09/086,392

[22] Filed: May 28, 1998

[30] Foreign Application Priority Data

Jun. 6, 1997 [DE] Germany ..... 197 23 945

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160, 161

[56] References Cited

U.S. PATENT DOCUMENTS

| | | | |
|---|---|---|---|
| 4,856,465 | 8/1989 | Denz et al. | 123/90.15 |
| 5,103,780 | 4/1992 | Ishii | 123/90.17 |
| 5,377,639 | 1/1995 | Nakadouzono et al. | 123/90.17 |
| 5,566,651 | 10/1996 | Strauss et al. | 123/90.17 |
| 5,645,021 | 7/1997 | Eguchi et al. | 123/90.17 |
| 5,713,319 | 2/1998 | Tortul | 123/90.17 |
| 5,765,517 | 6/1998 | Wiehl | 123/90.17 |
| 5,775,279 | 7/1998 | Ogawa et al. | 123/90.17 |
| 5,797,361 | 8/1998 | Mikame et al. | 123/90.17 |

FOREIGN PATENT DOCUMENTS

| | | |
|---|---|---|
| 29 09 803 C2 | 9/1979 | Germany . |
| 39 37 644 A1 | 5/1991 | Germany . |
| 196 23 818 A1 | 12/1996 | Germany . |
| 195 41 769 A1 | 5/1997 | Germany . |

*Primary Examiner*—Weilun Lo
*Attorney, Agent, or Firm*—Henry M. Feiereisen

[57] ABSTRACT

Apparatus for adjusting the valve timing of gas exchange valves in an internal combustion engine, includes a driving unit in driving relationship with a crankshaft, a driven unit fixedly secured to an intake camshaft or exhaust camshaft, and an adjusting member operatively connected to the driving unit and the driven unit and capable of reciprocating between two axially spaced end positions by a hydraulic medium. In order to prevent noise emission after ignition of the engine, a coupling member is provided to interact with the driving unit and to move between an idle position in which the coupling member is disengaged from the driving unit and an operative position in which the coupling member interlocks with the driving unit and effects a fixed rotative engagement between the driving unit and the driven unit to lock the adjusting member in place when pressure applied by hydraulic medium drops below a level required for displacing the adjusting member. The apparatus further includes a flow restrictor so positioned as to effect a cross sectional constriction in a flow passageway upstream of the coupling member to attenuate pressure pulsation generated by the hydraulic medium.

17 Claims, 4 Drawing Sheets

APPARATUS FOR ADJUSTING VALVE TIMING OF GAS EXCHANGE VALVES IN AN INTERNAL COMBUSTION ENGINE

BACKGROUND OF THE INVENTION

The present invention relates to an apparatus for adjusting valve timing, i.e. opening and closing timing, of gas exchange valves in an internal combustion engine.

German Pat. No. 29 09 803 discloses a valve timing adjusting apparatus of a type having a driving unit in driving relationship via a tension member to a crankshaft and a driven unit which is in fixed rotative engagement with an intake or exhaust camshaft. The driving unit is formed by a drive pinion and a housing secured to the drive pinion and having an inner wall. Sealingly guided along the inner wall of the housing for displacement in an axial direction by hydraulic medium between two end positions is an adjusting piston which axially bounds two pressure compartments which are alternately or simultaneously operatively connectable to a pressure medium supply or pressure medium drain. The adjusting piston is connected in one piece with a hollow-cylindrical sliding sleeve which is formed with two oppositely oriented helical gear sections. One of the gear sections is in mesh with a complementary helical gear formed on a wheel hub in fixed rotative engagement with the drive pinion, and the other one of the gear sections interacts with a complementary helical gear of the driven unit so as to effect a relative rotation and/or infinitely variable hydraulic attachment of the camshaft to the crankshaft when alternately or simultaneously admit hydraulic medium to the pressure compartments during movement of the adjusting piston.

At ignition of the engine, this valve timing adjusting apparatus of this type has the drawback that the adjusting piston travels at high speed to its end positions of maximum displacement and impacts an abutment repeatedly at considerable noise generation. This is due to the fact that after shutdown of the engine, the hydraulic medium gradually escapes from the valve timing adjusting apparatus so that the adjusting piston is no longer sufficiently supported hydraulically by the hydraulic medium. As a result of the cyclic irregularities of the camshaft, the displacement of the adjusting piston, which no longer has an adequate hydraulic support, into an end position at re-igniting of the engine is accompanied by the already mentioned significant noise generation or back and forth rattling between its end positions. This condition prevails during the period between ignition of the engine and filling of hydraulic medium into the pressure compartments, i.e. few seconds after the engine has been started.

German publication DE-OS 196 23 818 describes another valve timing adjusting apparatus for gas exchange valves of an internal combustion engine, including a driving unit in driving relationship via a traction member with a crankshaft and a driven unit in fixed rotative engagement with an intake camshaft or exhaust camshaft. The driving unit includes a drive unit in the form of an outer rotor which has a circumferential wall and two side walls to define a hollow space, with the driven unit including an impeller formed as inner rotor which is received in the hollow space and carries several radial vanes. These vanes are radially pivotable by hydraulic medium between two end positions in several working chambers demarcated by axial boundary walls in the hollow space of the drive pinion for subdividing each working chamber in two pressure compartments alternatively or simultaneously operatively connected to a pressure medium supply or pressure medium drain. When the pressure compartments are acted upon by hydraulic medium to pivot the vanes, the camshaft is rotated relative to the crankshaft and/or an infinitely variable hydraulic securement of the camshaft to the crankshaft is effected. The emission of excessive noise after start of the engine is thereby countered by providing an axially displaceable and spring-loaded coupling member which is fluidly connected to a working chamber and in fixed rotative engagement with the drive pinion when the pressure of the hydraulic medium drops below a level necessary to pivot the impeller into one of the end or intermediate positions of its vanes.

Practice has shown however that pressure oscillations or fluctuations are experienced in the pressure compartments even when maintaining a desired angle (hydraulic support) as well as during adjustment (relative rotation). These pressure oscillations are caused by changing moments of the camshaft acting on the inner rotor as well as by the cyclic irregularity of the camshaft. As the coupling member is fluidly connected to at least one working chamber for securement of the impeller to the drive pinion, the pressure oscillations are transmitted also onto the coupling member so that a low average value of the pressure and/or a high pressure for releasing the securement causes the coupling member to oscillate. The pressure jolts or intake jolts transmitted by the hydraulic medium result in an impact of the coupling member upon adjoining structural components, thereby generating considerable noise and leading to increased wear. At the same time, the oscillations of the coupling member may, depending on the hydraulic transmission, also adversely affect the support of the hydraulic medium columns in the apparatus and thereby retroactively reinforce the changing moments of the camshaft.

SUMMARY OF THE INVENTION

It is thus an object of the present invention to provide an improved valve timing adjusting apparatus, obviating the afore-stated drawbacks.

In particular, it is an object of the present invention to provide an improved valve timing adjusting apparatus for gas exchange valves in an internal combustion engine, by which rattling during the engine ignition phase and fluctuations of the adjustment angle between the camshaft and the crankshaft as well as noise emission caused by a coupling member for fixation of the driving unit to the driven units as a consequence of pressure oscillations of the hydraulic medium, are eliminated in a simple manner.

These objects, and others which will become apparent hereinafter, are attained in accordance with the present invention by providing a coupling member in one of the pressure compartments for effecting a non-rotative force transmission engagement between the driving unit and the driven unit in one or more rotational positions when the hydraulic medium applies a pressure which drops below a level required for displacing the adjusting piston, and arranging a flow restrictor in this pressure compartment for effecting a cross sectional constriction in a flow passageway between the coupling member and the adjusting piston and damping pressure pulsation of the hydraulic medium.

Through the provision of a coupling member and a flow restrictor in accordance with the present invention, the driving unit and the driven unit are positively locked to one another when the internal combustion engine is at a standstill and the valve timing adjusting apparatus is at an essentially pressureless state, to thereby in effect provide an interlocked starting position for preventing a relative rotation between the driving unit and the driven unit. Thus, any axial shift of the adjusting piston from the position when the apparatus enters a pressureless state is barred, thereby avoiding, on the one hand, rattle noises during re-ignition of the engine as a result of high-frequency impacts of the adjusting piston on adjacent structural components which define its end positions, and, on the other hand, undesired displacement of the adjusting piston, after ignition of the internal combustion engine, into a starting position that would complicate or even render a starting of the engine impossible.

According to another feature of the present invention, the coupling member is configured in the form of a locking piston which is fluidly connected to the respective pressure compartment and hydraulically shiftable in camshaft-distant direction along an axial guide. Axial displacement of the adjusting piston in camshaft-proximate direction is effected, preferably, by auxiliary energy produced by a spring member so that the adjusting piston is retained in camshaft-distant position by pressure applied by the hydraulic medium and shifted in camshaft-proximate direction by the spring member. Preferably, the spring member is formed as a compression spring or ondular spring washer, which surrounds the driving unit and bears with one end upon a camshaft-distant inner end face of the housing and with the other end upon a piston-distant surface of the locking piston. In the event of utilizing a compression spring as spring member, it is preferred to so dimension the compression spring that a small pressure applied by hydraulic medium on the adjusting piston is already sufficient to release the fixed engagement between the driving unit and the driven unit and to axially displace the adjusting piston.

Persons skilled in the art will understand that it is certainly within the scope of the present invention to use auxiliary energies other than those produced by a compression spring or ondular spring washer for effecting a displacement of the locking piston. Relevant is only to provide means that realize the fixed engagement between the driving unit and the driven unit and locking of the adjusting piston during the starting phase of the engine and deficient pressure application by hydraulic medium.

According to another feature of the present invention, the locking piston is formed as concentric ring of C-shaped cross section and has a shank exhibiting an inner wall surface provided, at least partially or sectionwise, with an axial straight or oblique gear which forms part of the axial guide. This locking piston is supported by a slide ring which is rigidly mounted to and partially surrounds the driven unit, with the slide ring having an outer circumferential surface which is provided, at least partially, with a gear complementing a gear of the locking piston for supporting the locking piston and forming another part of the axial guide. Thus, a non-geared section of the inner circumference of one shank of the locking piston slides upon a non-geared circumferential surface of the slide ring, while a geared section of the locking piston meshes with a geared section of the slide ring for effecting an axial straight or slight rotational motion.

According to another feature of the present invention, the locking piston has a piston-proximate surface formed with several concentric projections for form-fitting engagement in complementary recesses of the inner wall of the housing when the pressure applied by the hydraulic medium drops below a minimum level for displacement of the adjusting piston. The projections on the locking piston and the recesses in the housing thus provide an interlocking connection of the driving unit to the driven unit of the valve timing adjusting apparatus, and are preferably spaced at even number and even pitch about the piston surface of the locking piston and the housing so that this form-fitting connection is possible only in an end position of the adjusting piston, representing the preferred starting position. An arrangement of additional recesses on the housing enables however also to lock the adjusting piston in a position between the end positions, if the starting behavior of the engine were to permit this. Persons skilled in the art will understand that it is certainly within the scope of the present invention to provide a reversed configuration, i.e. to form the locking piston with recesses and to form the housing with complementary projections for engagement in the recesses.

According to still another feature of the present invention, the locking piston is sealed radially outwards and radially inwards by suitable seals from adjoining structural components, such as the housing of the valve timing adjusting apparatus and the slide ring supporting the locking piston, in order to ensure a hydraulic support of the adjusting piston substantially without leakage. Preferably, the locking piston is sealed against the housing by a piston seal ring accommodated in a ring groove at an end face of the locking piston. If desired, the piston seal ring may also be substituted by an elastomer seal. A sealing of the locking piston from the slide ring may also be effected by a piston seal ring or elastomer seal.

According to yet another feature of the present invention, the flow restrictor disposed between the coupling member and the adjusting piston may be formed as steel ring which has an outer perimeter secured to the housing and an inner circumference circumscribing the slide ring. Preferably, the steel ring is formed on its coupling member facing annular surface with a circumferential cross sectional constriction extending from the inner circumference in direction to the outer perimeter for providing a passageway for supply of hydraulic medium to the coupling member. With its outer periphery, the steel ring is sealingly connected to the housing of the valve timing adjusting apparatus. The remaining gap between the inner circumference of the flow restrictor and the slide ring of the driven unit enables hydraulic medium to flow via the cross sectional constriction of the flow restrictor to the locking piston when hydraulic medium is admitted into the camshaft-distant pressure compartment. Normally, the release of the locking piston tends to take slightly longer as a consequence of the relative small gap height as would be the case when no flow restrictor is provided. This practically negligible effect is however more than compensated by the advantage of effectively eliminating a transmission of pressure oscillations of hydraulic medium through this gap onto the locking piston so as to prevent any rattling noises emanating from the locking piston.

Persons skilled in the art will understand that it is certainly within the scope of the present invention to secure the flow restrictor about its inner circumference to the slide ring of the driven unit while the outer circumference of the flow restrictor is spaced by a gap to the housing of the valve timing adjusting apparatus and includes the mentioned cross sectional constriction in the flow passageway to the coupling member.

In accordance with another variation, the flow restrictor between the coupling member and the adjusting piston may be formed by two steel rings sliding with their axial faces upon another, with one of the steel rings having an inner circumference secured to the slide ring, and with the other one of the steel rings having an outer perimeter secured to the housing, whereby the axial face of each steel ring is formed with at least one bore for providing a passageway for supply of hydraulic medium to the coupling member when the bores of the steel rings are in alignment. Advantageously, the bores are formed as radial slots and so provided in the axial faces of the steel rings as to be in alignment only when the adjusting piston occupies one of the end positions and the coupling member is in locking position. As one of the steel rings is connected to the driving unit and the other one of the steel rings is connected to the driven unit, the relative rotation between the driving unit and driven unit is exploited to bar the supply of hydraulic medium and thus transmission of pressure oscillation via the hydraulic medium to the coupling member. Although the coupling member can thus not be held by hydraulic medium in an disengaged position, an unintentional locking of the coupling member is still not possible as the interconnecting projections and recesses in the coupling member and housing can positively engage only when the pressure applied by the hydraulic medium drops below a minimum pressure and the adjusting piston reaches an end position. This is the case, especially after shutdown of the engine so that the radial slots in the steel rings that form the flow restrictor are coincide and align only under these circumstances. At re-starting of the engine, the hydraulic medium can migrate immediately to the coupling member as a result of the formed passageway so that the coupling member can be released from the locked position after sufficient pressure buildup to thereby release the adjusting piston of the apparatus.

The principle of the present invention is equally applicable for a valve timing adjusting apparatus of a type including a driving unit which has a drive pinion in the form of an outer rotor and a driven unit fixedly secured to a camshaft and including an impeller forming an inner rotor and having at least one radial vane radially pivotable by hydraulic medium between two end positions in a working chamber which is formed in a hollow space of the outer rotor and subdivided by the vane in two pressure compartments for feeding and discharging hydraulic medium to and from the pressure compartments. In accordance with the present invention, the hydraulic connection between the coupling member and the working chamber includes a flow restrictor for effecting a cross sectional constriction and damping of pressure pulsations of the hydraulic medium.

This type of valve timing adjusting apparatus has the advantage that the coupling member for effecting the fixed rotative engagement between the driving unit and driven unit is substantially shielded from pressure oscillations caused by the changing moments of the camshaft and transmitted by the hydraulic medium. Through the provision of the flow restrictor between the pressure compartment or working chamber and the coupling member, these pressure oscillations are attenuated to such an extent that the coupling member is prevented from generating interfering rattling noises when holding a desired angle and executing an adjusting operation.

According to another feature of the present invention, the coupling member may be formed as locking pin which is arranged in an axial bore in one vane of the impeller for cooperation with a complementary bore in the side wall of the drive pinion. Terminating in this complementary bore in the side wall of the drive pinion is a channel which is fluidly connected to the working chamber interacting with the coupling member for supply of hydraulic fluid. Preferably, the flow restrictor forming a local cross sectional constriction is disposed in the channel via which the coupling member is disengaged when admitting hydraulic medium into the working chamber. It has proven advantageous to make the channel of slightly smaller diameter than the complementary bore in which the channel terminates to effect a greatest possible pressure attack area upon the end face of the locking pin. Extending from this enlarged section of the channel is the flow restrictor as localized cross sectional constriction. Downstream of the flow restrictor, the cross section of the channel is then slightly expanded, with the channel terminating in an annular groove of the inner rotor.

It is however certainly within the scope of the invention to position the flow restrictor at any other location of the channel which is connected to the working chamber interacting with the coupling member for supply of hydraulic medium, or to substitute the cross sectional constriction in the channel with a hydraulic throttle valve or the like. It is also possible to omit a flow restrictor or a throttle valve altogether in the hydraulic medium supply passageway while yet avoiding troubling noise emission of the coupling member as a result of pressure pulsations of the hydraulic medium, by providing, similar to the flow restrictor in the configuration of two abutting steel rings as described in connection with the first type of valve timing adjusting apparatus and thus omission of an annular groove in the inner rotor for supply of hydraulic medium to the coupling member, the channel in the inner rotor such as to be in alignment with the fluid channel in the outer rotor when the inner rotor is in fixed rotative engagement in one of its end positions with the outer rotor. During adjustment of the apparatus, the relative rotation between the inner rotor and the outer rotor bars the supply of hydraulic medium to the coupling element so that a transmission of pressure pulsations onto the coupling member is prevented.

Regardless of the type of valve timing adjusting apparatus, an advantageous starting position of the adjusting member, i.e. adjusting piston or inner rotor, is attained by exploiting the changing moments caused by the camshaft which effect that the adjusting element occupies one of its end positions ("late" or "premature" opening of the pertaining gas exchange valves) and is locked subsequently by the respective coupling member between the driving unit and the driven unit. The components for effecting a coupling of the driving unit with the driven unit and locking of the adjusting member as well as for effecting a damping of the pressure fluctuations can be made of simple construction and thus can be manufactured in a cost-efficient manner.

When employing a valve timing adjusting apparatus according to the present invention e.g. for an intake camshaft, the adjusting member should occupy a "late" end position for the starting position of the internal combustion engine to effect a small valve overlap and thus a low residual gas fraction within the cylinder. When being used for an exhaust camshaft, a starting position should be effected to enable a premature opening and closing of the respective gas exchange valves. Although the adjusting member (adjusting piston or inner rotor) should be shifted to its desired starting position by hydraulic medium admitted into the respective pressure compartment or working chamber immediately before shutdown of the internal combustion engine, operational conditions may exist that will not lead to this intended result, e.g. when the internal combustion engine is in operation only briefly or stalls unintentionally and is not restarted again. In this case, the coupling member cannot establish a fixed engagement between the driving unit and the driven unit so that the adjusting member momentarily shifts after starting the internal combustion engine. As soon as the adjusting member reaches for the first time after starting the engine the desired starting position, the driving unit and the driven unit are connected to one another and the adjusting member is retained in its starting position until the pressure compartments or working chambers are filled with sufficient hydraulic medium to hydraulically support the adjusting member.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1A:
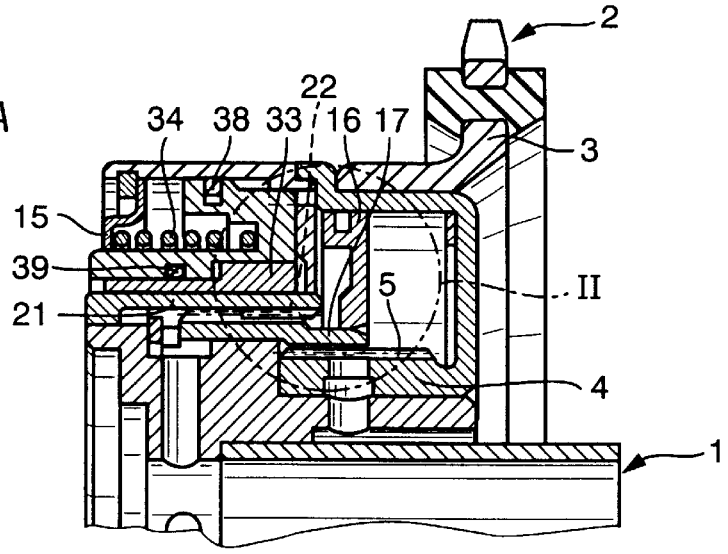
FIG. 1*a* is a longitudinal section of one type of a valve timing adjusting apparatus according to the present invention, showing the upper half of the apparatus, with the adjusting piston in locked position and illustrating one embodiment of a flow restrictor according to the present invention.

Throughout all the Figures, same or corresponding elements are generally indicated by same reference numerals.

Figure 1B:
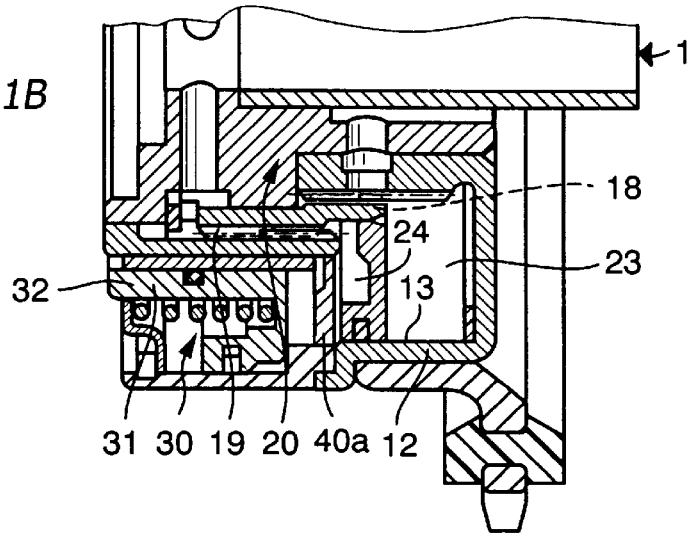
FIG. 1*b* is a longitudinal section of the valve timing adjusting apparatus of FIG. 1*a*; showing the lower half of the apparatus, with the adjusting piston in released position.

Turning now to the drawing, and in particular to FIGS. 1*a* and 1*b*, there are shown longitudinal sections of the upper and lower halves of one type of a valve timing adjusting apparatus according to the present invention, generally designated by reference numeral 1 for changing the opening and closing times of gas exchange valves (not shown) in internal combustion engines by adjusting a rotational relation between a driving unit, generally designated by reference numeral 2 and a driven unit, generally designated by reference numeral 20. The driving unit 2 is in driving relationship with a crankshaft (not shown) and includes a drive pinion 3 which is operatively connected via a traction member (not shown) such as timing belt (not shown) to the crankshaft for transmission of the driving force of the engine via the crankshaft to the drive pinion 3 and thus to an intake or exhaust camshaft which is in fixed rotative engagement with the driven unit 20, so as to operate the gas exchange valves. Although not shown in the drawing, the camshaft is rotatably supported in a cylinder head, with the valve timing control apparatus 1 being arranged in driving relationship between the camshaft and the driving unit 2.

Secured to the drive pinion 3 of the driving unit 2 is a housing 12 which has an inner wall 13 for sealingly guiding an adjusting piston 16 which is axially displaceable by a hydraulic medium between two end positions to separate two pressure compartments 23, 24 demarcated by the respective end faces of the adjusting piston 16 and operatively connectable alternately or simultaneously to a hydraulic medium supply and hydraulic medium drain. The adjusting piston 16 is formed in one piece with a hollow cylindrical slide sleeve 17 which includes two axially spaced, oppositely oriented helical internal and external gear sections 18, 19, with external helical gear section 18 meshing with a complementary helical gear section 5 formed internally on a wheel hub 4 which is in fixed rotative engagement with the drive pinion 3. The internal helical gear section 19 meshes with a complementary helical gear section 22 formed internally on a slide ring 21 of the driven unit 20.

As described above, at starting of the engine, the adjusting piston 16 should be held in a starting position until the valve timing adjusting apparatus 1 is filled sufficiently with hydraulic medium. This starting position is illustrated in FIGS. 1*a* and 1*b*, whereby the adjusting piston 16 occupies one of its end positions.

The adjusting piston 16 is held in this end position by a coupling unit, generally designated by reference numeral 30 which is disposed in the pressure compartment 24 and effects a non-rotative force transmission connection between the driving unit 2 and the driven unit 20 in one or more rotational positions relative to one another when the pressure applied by the hydraulic medium drops below a level necessary to displace the adjusting piston 16. The coupling unit 30 includes a locking piston 31 which is displaceable by hydraulic medium in a camshaft-distant direction and in a camshaft-proximate direction by auxiliary energy generated by a spring member 34. Thus, when hydraulic medium applies a pressure, the locking piston 31 is held in the camshaft-distant position (idle position), as shown in FIG. 1*b*, and when no pressure is applied is forced by the spring member 34 in direction toward the camshaft in order to hold the adjusting piston 16 in place (operative position). The spring member 34 for generating auxiliary energy for the locking piston 31 may be a compression spring which surrounds the driven unit 20 and bears, on the one hand, against a camshaft-distant inner wall 15 of the housing 12 and, on the other hand, against a piston surface 36 of the locking piston 31, facing away from the adjusting piston 16.

The locking piston 31 is configured in the shape of a concentric ring with C-shaped cross section and has a shank 32 which is provided at its inner circumference with an axial straight gearing that forms part of an axial guide 33. A further part of the axial guide 33 of the locking piston 31 is formed by a slide ring 21 which is rigidly connected to and partially surrounds the driven unit 20, with the slide ring 21 supporting the locking piston 31 and having an outer peripheral surface formed with a straight gearing complementing the straight gearing of the locking piston 31. The non-rotative force transmission engagement between the driving unit 2 and the driven unit 20 in one or more rotative positions relative to one another is effected by providing the locking pin 31 on its piston surface 35, which is directed toward the adjusting piston 16, with projections 37 (see in particular FIG. 2, showing only one projection by way of example) which projections 37 enter a form-fitting engagement in recesses 14 formed on an inner wall 13 of the housing, when the pressure applied by the hydraulic medium drops below a level required for displacement of the adjusting piston 16.

In order to ensure a hydraulic support of the adjusting piston 16 without leakage, the locking piston 31 is sealed radially outwards and radially inwards from adjoining structural components, such as housing 12 and slide ring 21, by seals, e.g. piston seal rings 38, 39, as shown in FIGS. 1*a* and 1*b*, with piston seal ring 38 sealing the locking piston 31 against the housing 12 and piston seal ring 39 sealing the locking piston 31 against the slide ring 21.

Figure 2:
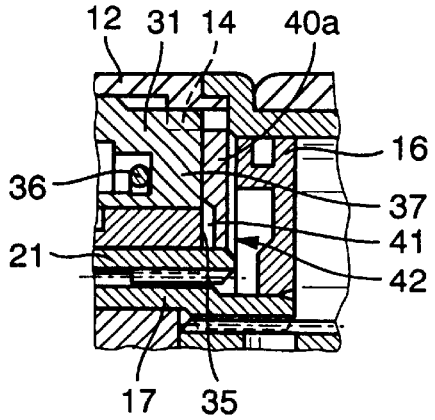
FIG. 2 is a cutaway view, on an enlarged scale, of the valve timing adjusting apparatus, showing a detailed illustration of an area marked II in FIG. 1*a;*

As further shown in FIGS. 1*a*, 1*b* and 2, the valve timing adjusting apparatus 1 includes a flow restrictor 40*a* which is disposed in the pressure compartment 24 for narrowing the cross section of a flow passageway between the coupling unit 30 and the adjusting piston 16. By way of this flow restrictor 40*a*, pressure pulsations of the hydraulic medium as a result of changing moments of the camshaft and acting via the hydraulic medium onto the coupling unit 30 are attenuated. The flow restrictor 40*a* is formed as a steel ring which has an outer perimeter bearing upon the housing 12 and surrounding the driving unit 20. The steel ring is preferably sealingly press-mounted to the housing 12 and has an annular surface which at its free inner marginal area facing the coupling unit 30 is formed with a continuous cross sectional constriction 41 to provide a passageway for supply of hydraulic medium to the coupling unit 30. A remaining gap 42 is defined between the inner diameter of the flow restrictor 40*a* and the slide ring 21 of the driven unit 20 and provides a passageway for hydraulic medium when the camshaft-distant pressure compartment 24 is acted upon by hydraulic pressure, with the hydraulic medium flowing through the gap 42 and the constriction 41 in direction toward the coupling unit 30 to move the locking piston 31 from the operative position shown in FIG. 1*a* into the idle position shown in FIG. 1*b* to thereby release the fixed rotative engagement between the projections 37 and recesses 14 and thus between the driving unit 2 and the driven unit 20 in opposition to the spring force applied by the spring member 34, and to thereby release the adjusting piston 16 and hold the adjusting piston 16 in place.

Figure 3A:
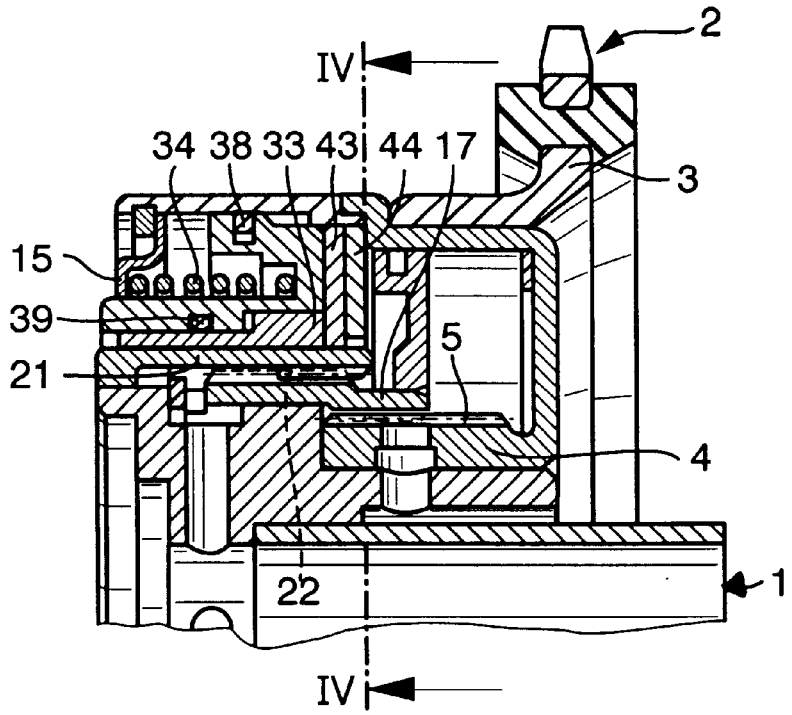
FIG. 3*a* is a longitudinal section of a valve timing adjusting apparatus according to the present invention; showing the upper half of the apparatus, with the adjusting piston in a locked position and illustrating another embodiment of a flow restrictor according to the present invention.
Figure 3B:
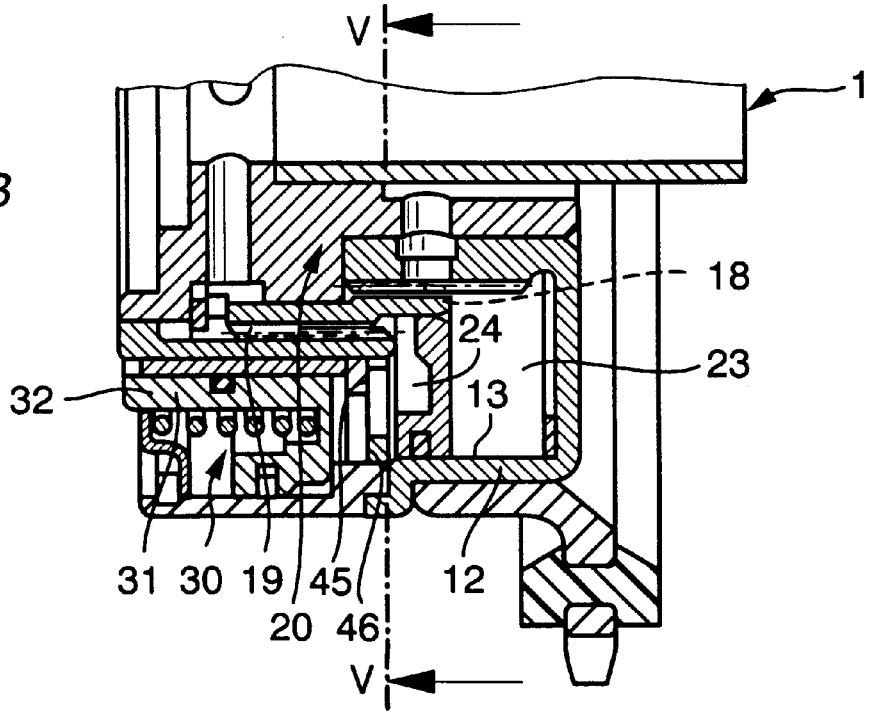
FIG. 3*b* is a longitudinal section of the valve timing adjusting apparatus of FIG. 3*a*; showing the lower half of the apparatus, with the adjusting piston in a released position.
Figure 4:
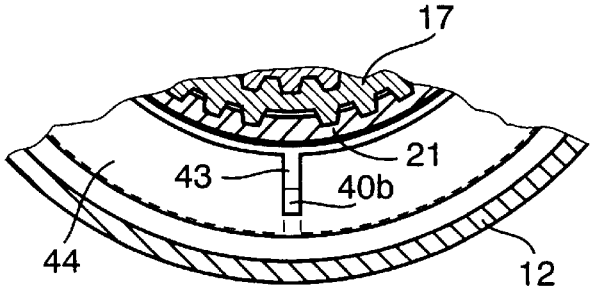
FIG. 4 is a cutaway view, on an enlarged scale, of the valve timing adjusting apparatus, taken along the line IV—IV in FIG. 3*a;*
Figure 5:
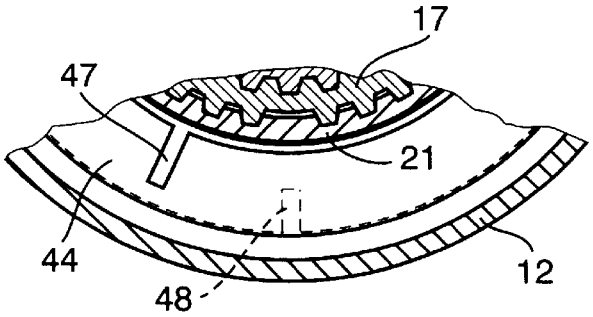
FIG. 5 is a cutaway view, on an enlarged scale, of the valve timing adjusting apparatus, taken along the line V—V in FIG. 3*b;*

Turning now to FIGS. 3*a* and 3*b*, there are shown longitudinal sections of the upper and lower halves of a variation of the valve timing adjusting apparatus 1, with the difference to the embodiment shown in FIGS. 1*a* and 1*b*, residing in the configuration of the flow restrictor. FIGS. 3*a* and 3*b* show the provision between the coupling unit 30 and the adjusting piston 16 of a flow restrictor 40*b* which is formed by two steel rings 43, 44 slidingly abutting with their axial faces 45, 46 upon one another. The steel ring 43 has an inner circumferential area which is securely mounted to the slide ring 21 of the driven unit 20, and the steel ring 44 has an outer peripheral surface which is securely mounted to the housing 12 of the driving unit 2. As shown in particular in FIGS. 4 and 5, each of the axial faces 45, 46 of the steel rings 43, 44 includes a bore in the form of a radial slot 47, 48. The radial slots 47, 48 are thereby so positioned as to provide a passageway for hydraulic medium to the coupling unit 30 when coinciding with one another, whereby the superimposed disposition of the radial slots 47, 48 occurs only when the adjusting piston 16 occupies the end position shown in FIG. 4 and the coupling unit 30 is in locking position. During adjusting operation of the apparatus 1, the fluid passageway to the coupling unit 30 is barred, as shown in FIG. 5, to thereby prevent any transmission of pressure oscillations to the coupling unit 30 via the hydraulic medium.

Figure 6:
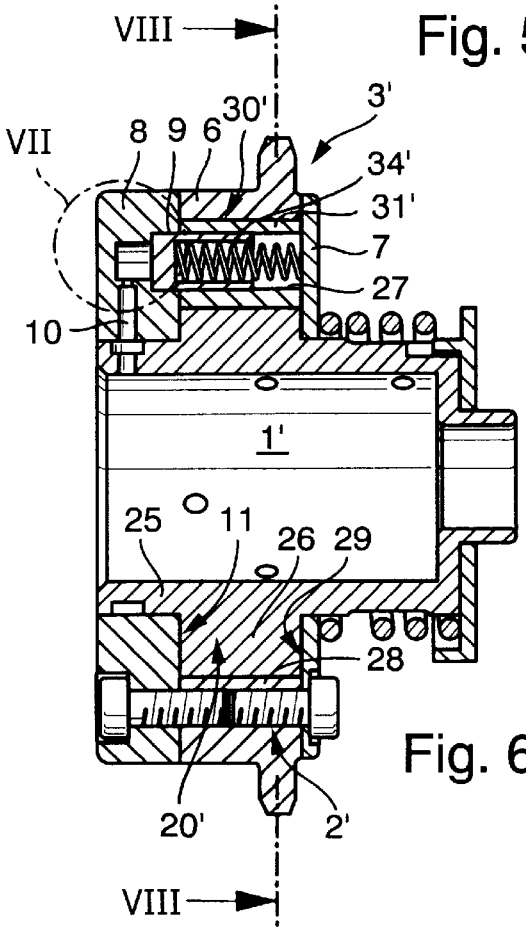
FIG. 6 is a longitudinal section of another type of a valve timing adjusting apparatus according to the present invention.
Figure 8:
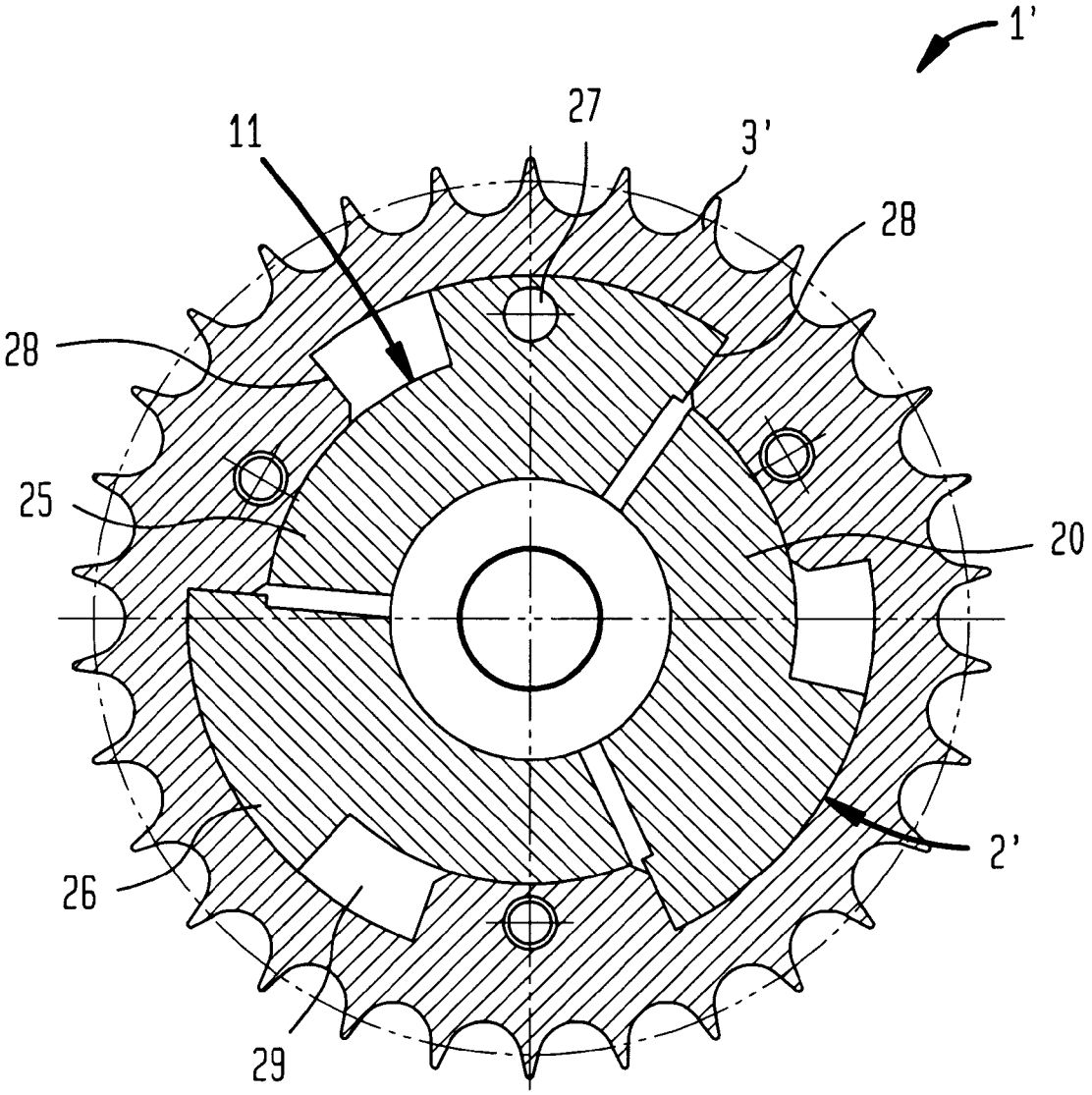
FIG. 8 is a sectional view of the valve timing adjusting apparatus of FIG. 6, taken along the line VIII—VIII in FIG. 7.

Turning now to FIG. 6, there is shown a longitudinal section of another type of a valve timing adjusting apparatus according to the present invention, generally designated by reference numeral 1'. The valve timing adjusting apparatus 1' includes a driving unit 2' which has a drive pinion in the form of an outer rotor 3', with the outer rotor 3' being formed by a circumferential wall 6 extending between two-spaced apart parallel side walls 7, 8 thereby defining a hollow space 11. The driven unit 20' includes an impeller 25 which forms an inner rotor accommodated in the hollow space 11 of the driving unit 2' and carrying three radial vanes 26, as shown in FIG. 8. Each one the vanes 26 is radially pivotable by hydraulic medium between two end positions within working chambers 29 which are demarcated by axial boundary walls 28 in the hollow space 11, whereby the number and pitch of the boundary walls 28 is identical to the number and pitch of the vanes 26 on the impeller 25. The vanes 26 of the impeller 25 separate each working chamber 29 in a manner known per se into two pressure compartments which are operatively connectable alternately or simultaneously to a pressure medium supply and a pressure medium drain so as to effect a relative rotation and/or continuous hydraulic securement of the camshaft to the crankshaft of the internal combustion engine when the vanes 26 are acted upon by pressure via one or both pressure compartments per working chamber 29.

The valve timing adjusting apparatus 1' is further provided with an axially displaceable coupling unit 30' which is fluidly connected with a working chamber 29 for fixedly securing in a non-rotative manner the impeller 25 in one of the end positions of its vanes 26 when the pressure applied by the hydraulic medium drops below a level required for pivoting the impeller 25.

Figure 7:
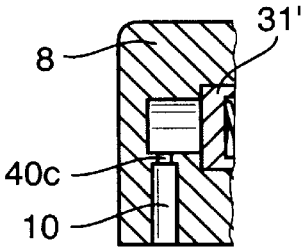
FIG. 7 is a cutaway view, on an enlarged scale, of the valve timing adjusting apparatus, showing a detailed illustration of an area marked VII in FIG. 6.

The coupling unit 30' includes a locking pin 31' which is arranged in an axial bore 27 in one of the vanes 26 of the impeller for cooperation with a complementary bore 9 in the side wall of the outer rotor 3', with FIG. 6 showing the locked position of the locking pin 31'. Terminating in the bore 9 of the side wall 8 is a pressure medium channel 10 which is provided a passage for hydraulic medium into the working chamber 29 cooperating with the locking pin 31'. As best seen in FIG. 7, the hydraulic connection in the form of the channel 10 between the working chamber 29 interacting with the coupling unit 30' and the coupling unit 30' includes a localized flow restrictor 40*c* for narrowing the cross section of the passageway so as to attenuate pressure pulsations of the hydraulic medium, caused by changing moments of the camshaft. When the working chamber 29 is acted upon by pressure upon ignition of the engine, the locking pin 31' is moved from the position shown in FIG. 6 into the opposite end position within the vane 26 of the impeller 25 in opposition to the force exerted by a spring member 34' which extends between an inside wall surface of the locking pin 31' and the opposite side wall 7 of the outer rotor 3' and so loads the locking pin 3' as to seek an engagement with the bore 9. Thus, the fixed engagement of the impeller 25 with the drive pinion (outer rotor) 3' is released, with the flow restrictor 40*c* preventing in the channel 10 a back-and-forth movement of the locking pin 31' between its end positions and thereby generation of rattling noises.

While the invention has been illustrated and described as embodied in an apparatus for adjusting valve timing of gas exchange valves in an internal combustion engine, it is not intended to be limited to the details shown since various modifications and structural changes may be made without departing in any way from the spirit of the present invention.

What is claimed as new and desired to be protected by Letters Patent is set forth in the appended claims:

What is claimed is:

1. Apparatus for adjusting valve timing of gas exchange valves in an internal combustion engine, comprising:

a driving unit in driving relationship with a crankshaft via a tension member, said driving unit including a drive pinion having a hub, and a housing mounted to the drive pinion and defining an inner wall;

a driven unit fixedly secured to a camshaft;

a piston unit including an adjusting piston sealingly guided along the inner wall of the housing for displacement in an axial direction by a hydraulic medium between two end positions, thereby defining two pressure compartments operatively connected alternately or simultaneously with a pressure medium supply and a pressure medium drain, and a hollow-cylindrical sliding sleeve formed in one piece with the adjusting piston, said adjusting piston having two oppositely oriented helical gear sections in spaced-apart relationship, with one of the gear sections capable of meshing a complementary helical gear formed on the hub of the drive pinion, and with the second gear section capable of meshing a complementary helical gear of the driven unit;

a coupling unit including a coupling member positioned in one of the pressure compartments for effecting a non-rotatable fixed force transmission engagement between the driving unit and the driven unit in one or more rotative positions relative to one another when the hydraulic medium applies a pressure which drops below a level required for displacing the adjusting piston; and a flow restrictor positioned in the one of the pressure compartments for effecting a cross sectional constriction in a passageway between the coupling unit and the adjusting piston and damping pressure pulsations of the hydraulic medium.

2. The apparatus of claim 1 wherein the coupling unit effects the non-rotative fixed engagement between the drive unit and the driven unit in one of the end positions of the adjusting piston.

3. The apparatus of claim 1 wherein the coupling unit includes an axial guide guiding the coupling member for movement in an axial direction.

4. The apparatus of claim 1 wherein the coupling member is a locking piston movable in a camshaft-distancing direction by hydraulic medium, said coupling unit including a spring member for producing an auxiliary energy for so loading the locking piston as to seek a displacement in a camshaft-approaching direction.

5. The apparatus of claim 3 wherein the coupling member is a concentric ring of C-shaped cross section and has a shank exhibiting an inner wall surface provided, at least partially or sectionwise, with an axial gearing to form part of the axial guide.

6. The apparatus of claim 5 wherein the axial gearing comprises straight splines.

7. The apparatus of claim 5 wherein the axial gearing comprises helical splines.

8. The apparatus of claim 5, and further comprising a slide ring rigidly mounted to and partially surrounding the driven unit for supporting the coupling member, said slide ring having outer circumferential surface provided, at least partially, with a gearing complementing the gearing of the coupling member and forming another part of the axial guide.

9. The apparatus of claim 1 wherein the coupling member has a piston-proximate surface formed with at least one projection for positive engagement in a complementary recess of the inner wall of the housing when the pressure applied by the hydraulic medium drops below a level required for displacement of the adjusting piston.

10. The apparatus of claim 1 wherein the coupling member has a piston-proximate surface formed with a plurality of concentric projections for positive engagement in complementary recesses of the inner wall of the housing when the pressure applied by the hydraulic medium drops below a level required for displacement of the adjusting piston.

11. The apparatus of claim 1, and further comprising a sealing means for effecting a sealing engagement in radially outwards and radially inwards directions between the coupling member and adjoining structural components.

12. The apparatus of claim 11, and further comprising a slide ring rigidly mounted to and partially surrounding the driven unit for supporting the coupling member, said sealing means including annular piston seals positioned between the coupling member and the adjacent housing and between the coupling member and the adjacent slide ring.

13. The apparatus of claim 4 wherein the spring member is a compression spring, said spring member surrounding the driven unit and having opposite ends, with one end bearing upon a camshaft-distant inner end face of the housing and with the other end bearing upon a piston-distant surface of the coupling member.

14. The apparatus of claim 1, and further comprising a slide ring rigidly mounted to and partially surrounding the driven unit for supporting the coupling member, said flow restrictor being a steel ring having an outer perimeter secured to the housing and an inner circumference circumscribing the slide ring.

15. The apparatus of claim 14 wherein the flow restrictor has an annular surface which faces the coupling member and is formed at its free marginal area with a circumferential cross sectional constriction extending from the inner circumference in direction to the outer perimeter for providing a passageway for supply of hydraulic medium to the coupling member.

16. The apparatus of claim 1, and further comprising a slide ring rigidly mounted to and partially surrounding the driven unit for supporting the coupling member, said flow restrictor being formed by two steel rings having axial surfaces slidingly abutting one another, with one of the steel rings having an inner circumference secured to the slide ring, and with the other one of the steel rings having an outer perimeter secured to the housing, each of said steel rings being formed with at least one bore for providing a passageway for supply of hydraulic medium to the coupling member when the bores of the steel rings are in alignment.

17. The apparatus of claim 16 wherein the bores of the steel rings are configured as radial slots so positioned in the axial surfaces as to be in alignment when the adjusting piston occupies one of the end positions and the coupling unit is in locking position.

* * * * *